US005326338A

United States Patent [19]

Makous

[11] Patent Number: 5,326,338

[45] Date of Patent: Jul. 5, 1994

[54] LATERAL EXERCISE APPARATUS AND METHOD

[76] Inventor: Joseph M. Makous, 53 Jefferson St., Bala Cynwyd, Pa. 19004

[21] Appl. No.: 3,271

[22] Filed: Jan. 12, 1993

[51] Int. Cl.[5] ..... A63B 23/04

[52] U.S. Cl. ..... 482/51; 434/253

[58] Field of Search ..... 482/51, 13, 70, 71, 482/148, 70; 434/253

[56] References Cited

U.S. PATENT DOCUMENTS 5,133,700 7/1992 Braathen ..... 482/51

*Primary Examiner*—Stephen R. Crow

*Attorney, Agent, or Firm*—David N. Makous; John S. Christopher; Lewis D'Amato

[57] ABSTRACT

A lateral exercise apparatus for use in performing side-to-side skating movements having a surface layer for performing the skating movements on each side thereof. Each side of the surface layer has a very low coefficient of friction. A plurality of adjustable clamps are utilized to adjust the length of the surface layer with each adjustable clamp including at least one pair of releasable clamping surfaces for gripping the surface layer. Each of a plurality of resilient bumpers are removably interlocked to one of the releasable clamping surfaces of each of the adjustable clamps for terminating the side-to-side skating movements. The resilient bumpers are wedge-shaped and have a low impact surface angle Θ of less than or equal to 20°. Finally, a high friction layer is provided for underlying and securing the surface layer to a floor surface. In a preferred embodiment, the surface layer is comprised of high density polyethylene while the high friction layer is a combination of nylon and polyvinylchloride. The high friction layer is placed between the surface layer and the floor surface to eliminate movement of the surface layer. The length of the surface layer is hand adjusted by the clamps. The bumpers are removably interlocked to and adjusted with the clamps and are utilized to initiate and terminate the skating motion. The low impact surface angle Θ of the bumpers is orthopedically correct and minimizes potential for injury.

15 Claims, 1 Drawing Sheet

LATERAL EXERCISE APPARATUS AND METHOD

BACKGROUND OF THE INVENTION

1. Field of the Invention

The present invention relates to exercise equipment. More specifically, the present invention relates to methods and apparatus for a lateral exercise apparatus used for rehabilitation and fitness aerobic training.

2. Description of the Related Art

A lateral exercise or training apparatus is a device that enables an athlete to simulate a side-to-side skating motion while remaining virtually in one location. Speed skaters utilize the stationary exercise apparatus as a training aid to improve physical conditioning and technical form. Every lateral exercise apparatus includes a low frictional surface of sufficient length to allow comfortable side-to-side motion and a stopping mechanism affixed to each end of the surface to terminate the side-to-side motion. Skaters normally practice the side-to-side motion on the low frictional surface in stocking feet. In the alternative, nylon booties can be placed over athletic shoes for use on the low frictional surface.

An example of a rudimentary lateral exercise apparatus typically includes a piece of rigid formica board approximately eight feet long and three feet wide. The surface of the formica board is periodically waxed to provide a low coefficient of friction. Two sections or blocks of wood, referred to as bumpers, are nailed to the top surface at each end of the formica board. The two sections of wood are positioned parallel to one another and orthogonal to the direction of foot movement on each end of the formica board. Each bumper serves to stop the side-to-side skating motion on the surface of the formica board.

During use, the skater positions one foot against the first bumper to exert a force that propels him to the opposite end of the formica board. The exerted force causes the skater to slide to the second bumper located at the opposite end of the board. The other foot intersects the second bumper which serves to terminate the skater's slide. The process is then reversed by positioning the appropriate foot against the second bumper to exert a force that propels the skater back to the first end of the formica board. Continuous repetition of the exercise simulates skating and serves as an inexpensive substitute to hone ones skills.

The simulated skating or sliding motion described above has been shown to be beneficial in both fitness and rehabilitation programs. In particular, this motion has been shown to be excellent for knee joint rehabilitation. Moreover, this motion provides general benefits for all athletes since it improves balance. Further, the skating motion assists in strengthening portions of the human body that are difficult to exercise by more traditional methods such as rowing and cycling. The skating or sliding motion also teaches proper weight shift during lateral movement. This feature not only enhances performance, it also assists in preventing injury. Finally, the skating or sliding motion provides a rigorous aerobic workout which improves conditioning.

The construction of the lateral exercise apparatus employing the rigid formica board has several disadvantages. It is expensive to build and is non-portable which limits the functionality. Further, the construction is not orthopedically correct which can lead to injury to the knee and ankle joints of a user. Also, the rigid formica board requires periodic waxing maintenance to ensure a minimum level of sliding performance and the length of the sliding surface is not adjustable.

It was recognized that a more convenient and functional lateral exercise apparatus was necessary. A solution to some of these problems appeared with the development of several simulated skating exercise devices. Various types of simulated skating exercise devices which are intended to be utilized in athletic training environments have been known in the prior art. By way of example, several forms of such devices can be found in U.S. Pat. Nos. 4,779,862, 4,940,227 and 5,076,571.

The simulated skating exercise devices disclosed by the above-recited U.S. Patents and other devices known in the art teach (a) a low friction, flexible, plastic gliding surface for sliding thereacross, (b) a clamping assembly comprising wooden or metal components attached to the gliding surface with nuts and bolts or screws, and (c) a pair of bumpers comprised of wood, metal or hard plastic having a foot impact angle with the horizontal within the range of 15° to 90°.

Several problems exist with the prior art simulated skating exercise devices mentioned above. The low friction, flexible, plastic gliding surface does not remain stationary on the floor surface when the skater applies a force to one of the bumpers. Consequently, the entire lateral exercise device will move across the floor. In models in which the bumpers are held in place by a pressure friction grip, the bumpers also tend to slide across the low friction gliding surface when force is applied to one of the bumpers. In other models, the low friction gliding surface is not easily adjusted or cannot be rolled and thus is not portable.

In the simulated skating exercise devices of the prior art, the bumpers are fashioned from a hard material which, after extended use, can result in bruised or injured feet. In the case of wooden bumpers, the sharp surfaces of the bumpers are hazardous to the feet and the bumper surfaces tend to crack and fail along the grain of the wood. Further, the range of foot impact angles (e.g., angle with the horizontal floor surface) designed in the bumpers can result in foot damage over time. The greater the acute angle, the higher the probability of injury to the foot.

Other problems include non-adjustable bumpers and clamping assemblies which prohibit changing the length of the low friction gliding surface, clamping surfaces that employ screws which penetrate and thus subject the gliding surface to damage, and gliding surfaces having a non-skid material adhered to the bottom side thereof. By adhering a non-skid material to the bottom side, use of the bottom side is eliminated and the longevity of the low friction gliding surface is limited to the life of the top side. Finally, the gliding surface of some prior art simulated skating exercise devices must be treated periodically with a silicon solution to maintain the low friction feature.

Thus, there is a need in the art for an improvement in lateral exercising devices which utilizes rigid but resilient bumpers having a very low profile angle with the horizontal to eliminate potential damage to the foot, employs an adjustable bumper and clamping assembly and a double-sided low friction gliding surface, and incorporates a high friction sub-base surface to ensure stationary operation.

SUMMARY OF THE INVENTION

The need in the art is addressed by the lateral exercise apparatus and method of the present invention. The invention is employed to perform side-to-side skating movements and includes a surface layer for performing the skating movements on each side thereof. Each side of the surface layer has a very low coefficient of friction. A plurality of adjustable clamps are utilized to adjust the length of the surface layer with each adjustable clamp including at least one pair of releasable clamping surfaces for gripping the surface layer. Each of a plurality of resilient bumpers are removably interlocked to one of the releasable clamping surfaces of each of the adjustable clamps for terminating the side-to-side skating movements. The resilient bumpers are wedge-shaped and have a low impact surface angle Θ of less than or equal to 20°. Finally, a high friction layer is provided for underlying and securing the surface layer to a floor surface.

In a preferred embodiment, the surface layer is comprised of high density polyethylene while the high friction layer is a combination of nylon and polyvinylchloride. The high friction layer is placed between the surface layer and the floor surface to eliminate movement of the surface layer. The length of the surface layer is hand adjusted by the clamps. The bumpers are removably interlocked to and adjusted with the clamps and are utilized to initiate and terminate the skating motion. The low impact surface angle Θ of the bumpers is orthopedically correct and minimizes potential for injury.

DESCRIPTION OF THE INVENTION

Figure 1:
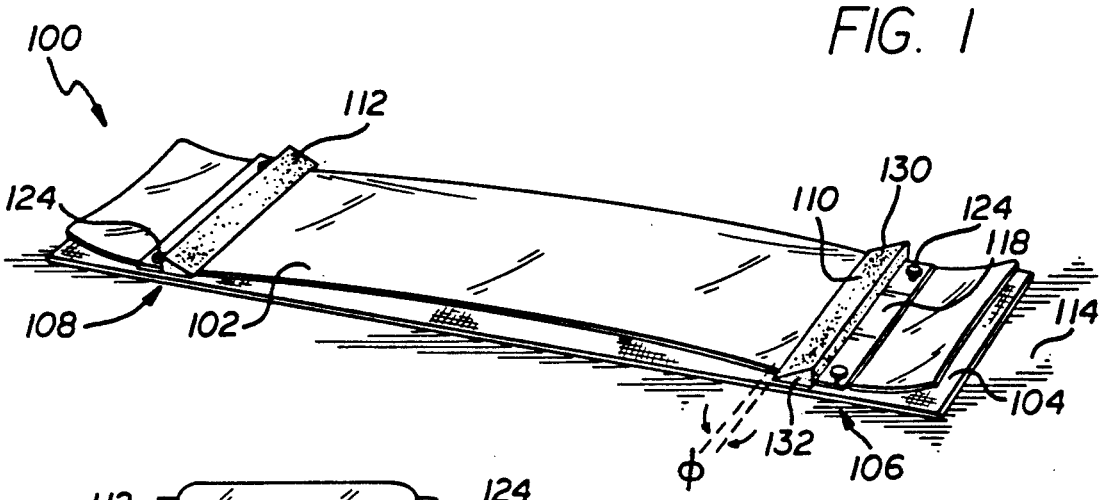
FIG. 1 is a perspective view of an illustrative embodiment of a lateral exercise apparatus in accordance with the present invention showing a very low friction surface layer held in position by an adjustable clamp assembly which incorporates interlocking bumpers having a low impact surface angle Θ.

The invention is a lateral exercise apparatus 100 as shown in FIG. 1. The lateral exercise apparatus 100 comprises an elongated, low friction surface layer 102, a high friction sub-surface layer 104, a pair of adjustable clamp assemblies 106 and 108 mounted at each end of the low friction surface layer 102, and a pair of low impact, resilient bumpers 110 and 112 each mounted to a corresponding one of the adjustable clamp assemblies 106 and 108.

Figure 2:
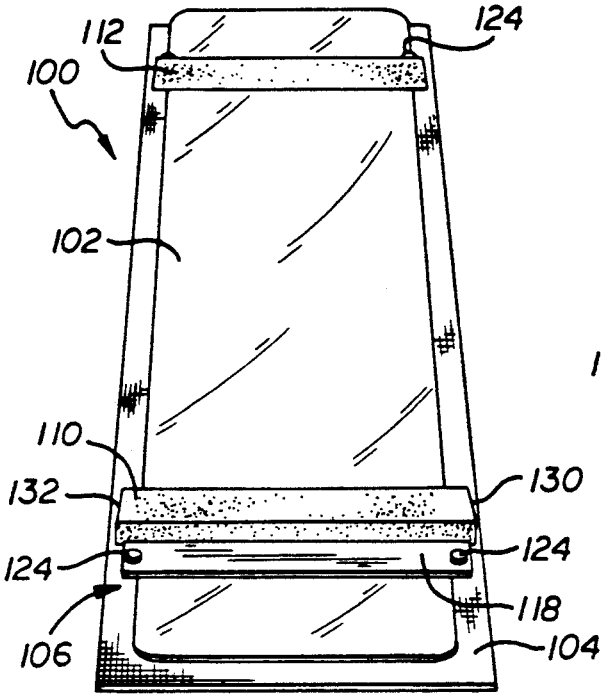
FIG. 2 is another perspective view of the lateral exercise apparatus of FIG. 1 showing more detail of the adjustable clamp assembly with respect to the very low friction surface layer shown positioned above a high friction sub-surface layer.

The elongated, low friction surface layer 102 shown in FIGS. 1 and 2 is the surface upon which the side-to-side skating or sliding movements are executed. The dimensions of the surface layer 102 can be customized to accommodate the skating or sliding requirements of a wide range of individuals. Thus, the length of the surface layer 102 can be as short as 5' for smaller persons and as long as 10' or more for larger persons. Although the width of the surface layer 102 need only be 12", a more preferable width dimension falls within the minimum-maximum range of 18" to 48".

The surface layer 102 is comprised of high density polyethylene plastic having a thickness within a specified range. It has been found through experiment that a surface layer thickness of less than 0.06" is not sufficiently robust (e.g., too flimsy) and thus fails to satisfy the durability requirement. However, a surface layer thickness of greater than 0.125" is too robust (e.g., too thick) and fails to satisfy the flexibility requirement as the polyethylene plastic cannot be rolled into a cylindrical shape.

One of the many distinguishing features of the present invention is that the high density polyethylene plastic of the surface layer 102 is formulated to contain an additive that significantly lowers the coefficient of friction thereof. The additive is a fatty acid amide normally used in the plastics industry and is commonly referred to as "slip". An atypical concentration of the friction lowering additive is utilized which lowers the friction of both sides of the surface layer 102. Normally, 0.1% of the friction lowering additive per unit volume is deemed to be a high concentration in conventional applications. In the present invention, a concentration of from 0.18% to 0.36% additive per unit volume is utilized. Once the additive is applied, curing occurs causing the polyethylene plastic to become more slippery over time on both sides of the surface layer 102. As a result, the surface layer 102 becomes more durable and longevity increases since both sides of the plastic are usable.

The concentration of the friction lowering additive is from 1½-to-3 times the recommended concentration for conventional applications. Therefore, the decrease in coefficient of friction of the surface layer 102 is significant resulting in a low maintenance advantage. Therefore, waxing and other maintenance of the double-sided surface layer 102 is not required to obtain the proper glide in the side-to-side skating movements. Experimentation has shown that even after significant marring of the surface layer 102, virtually the same coefficient of friction for this application is maintained. As a result, a wide range of materials such as cloth, paper or nylon can be worn on the foot when sliding over the specially treated surface layer 102.

The high friction sub-surface layer 104 underlies the surface layer 102 as is clearly shown in FIGS. 1 and 2. The dimensions of the sub-surface layer 104 are preferably somewhat larger than those of the surface layer 102 to prevent marring a floor surface 114 upon which the surface layer 102 is positioned. The sub-surface layer 104 can be comprised of a combination of nylon and polyvinylchloride materials. A material having this combination is manufactured and marketed by Vantage Industries of Atlanta, Ga. under the name "Hold-Tite". The sub-surface layer 104 serves to increase the frictional grip between the surface layer 102 and the floor surface 114. This result occurs since the frictional force is increased between the surface layer 102 and the sub-surface layer 104 and between the sub-surface layer 104 and the floor surface 114.

By providing the high friction sub-surface layer 104, the low friction surface layer 102 does not slide across the floor surface 114 and the resilient bumpers 110 and 112 do not slide across the low friction surface layer 102 during use of the apparatus 100. Furthermore, the high friction sub-surface layer 104 ensures that the low friction surface layer 102 can be rolled into a cylindrical shape within the sub-surface layer 104 for portability and storage purposes. Thus, the lateral exercise apparatus 100 can be rigorously utilized to perform side-to-side skating or sliding movements without causing the surface layer 102 to move with respect to the floor surface 114.

Figure 3:
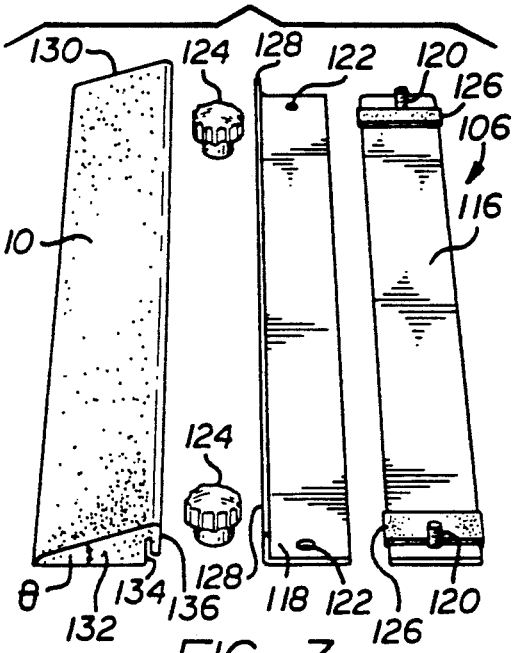
FIG. 3 is a detailed plan view of the adjustable clamp assembly and the interlocking low impact bumpers disassembled for illustration purposes.
Figure 4:
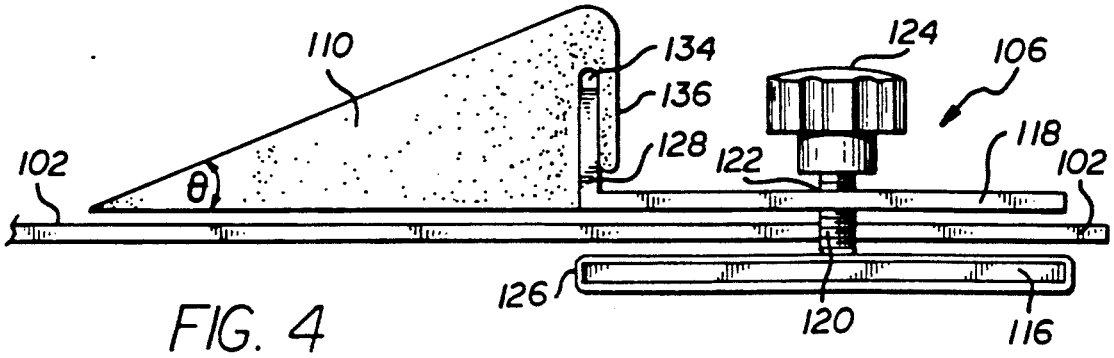
FIG. 4 is a side elevational view showing more detail of the adjustable clamp assembly and the interlocking low impact bumpers.

The adjustable clamp assemblies 106 and 108 are identical and each include a clamp base 116 and a corresponding clamp top 118 best shown in FIG. 3. The clamp base 116 includes a pair of upward extending threaded bolts 120 for extending through corresponding penetrations 122 in the clamp top 118. The clamp base 116 and clamp top 118 can be comprised of rigid material such as aluminum or extruded plastic. The threaded bolts 120 can include any suitable bolt structure known in the art such as, for example, PEM studs. A pair of hand operated knobs 124 for threadingly receiving the bolts 120 are also provided to permit the clamp top 118 to be locked to and released from the clamp base 116. A pair of heavy duty rubber straps 126 are wrapped about the clamp base 116 to increase the frictional grip of the clamp assemblies 106 and 108 on the surface layer 102 passing between the clamp base 116 and the clamp top 118. The clamp top 118 also includes an upward extending right angle sect ion 128 employed for securing the resilient bumpers 110 and 112 as shown in FIG. 4.

The adjustable clamp assemblies 106 and 108 each serve several purposes in the lateral exercise apparatus 100 of the present invention. The clamp base 116 and the clamp top 118 of each of the clamp assemblies 106 and 108 serve to control the distance between the two resilient bumpers 110 and 112. In effect, this adjustment controls the length of the surface layer 102 for performing the side-to-side skating movements. As is shown in FIGS. 2 and 4, the surface layer 102 is positioned over the sub-surface layer 104 with the ends of the surface layer 102 draped across the respective clamp base 116 between the upward extending threaded bolts 120. The desired length of the surface layer 102 is controlled by positioning the respective clamp bases 116. The clamp top 118 is then lowered over the clamp base 116 so that the bolts 120 pass through the corresponding penetrations 122. Thereafter, the knobs 124 are hand tightened onto the bolts 120 to lock the clamp top 118 to the clamp base 116.

The knobs 124, which can be made of plastic or metal, serve to compress the clamp top 118 to the clamp base 116 to grab the surface layer 102. Since the polyethylene plastic of the surface layer 102 includes a friction lowering additive, the heavy duty rubber straps 126, best shown in FIG. 3, increase the friction between the clamp base 116 and the surface layer 102. The rubber straps 126 are each positioned inboard of the bolts 120 of the clamp base 116 to prevent loss of the straps 126.

As the knobs are tightened by hand, the friction between the clamp base 116 and the surface layer 102 is increased substantially due to the rubber straps 126. This design prevents the clamp assemblies 106 and 108 from moving along the surface layer 102 during use of the lateral exercise apparatus 100. However, after the knobs 124 are loosened, the friction between the clamp base 116, the surface layer 102 and the rubber straps 126 is sufficiently lowered to permit removal of the clamp assemblies 106 and 108 for transporting or replacement of parts. The rubber straps 126 also contribute to increasing the friction between the clamp base 116 and the sub-surface layer 104.

Typically, the feet of the individual performing the side-to-side skating movements are angled outward as the foot slides across the surface layer 102. In particular, the inner and outer toes are at an angle with respect to a centerline passing through the heel. Thus, the toes are wider than the heel. This geometry results in the front outer portion of the foot striking one of the two resilient bumpers 110 or 112 before the heel. After repetitively striking the bumpers 110 and 112 with the outer front or toe portion of the foot, bruising or injury can result. It is desirable to have all points along the outside of the foot surface strike the resilient bumpers 110 and 112 simultaneously. This condition minimizes potential foot injury and is accomplished by slightly angling each clamp assembly 106 and 108 and the corresponding mounted resilient bumper 110 and 112, respectively, as shown in FIG. 1.

Thus, another function of the clamp assemblies 106 and 108 in the present invention is to provide a toe out adjustment. Note that each clamp assembly 106 and 108 is slightly angled outward. The angle is best shown in FIG. 1 as being formed from the rear 130 to the front 132 of each mounted resilient bumper 110 and 112. Thus, the resilient bumpers 110 and 112 are farther apart in the foreground than in the background. By this adjustment, an angle $\phi$ is formed within the plane of surface layer 102 between a line parallel to the edge of the surface layer 102 and each resilient bumper 110 and 112 as shown in FIG. 1. The angle $\phi$ is shown associated with the bumper 110 for illustration purposes only but also applies to bumper 112.

The size of angle $\phi$ differs slightly for each user and possibly for each foot. Thus, the size of angle $\phi$ must be adjusted for each user. This is easily accomplished since the distance between the threaded bolts 120 extending from the clamp base 116 is approximately $\frac{1}{2}''$ wider than the surface layer 102. The $\frac{1}{2}''$ clearance ensures that the clamp assemblies 106 and 108 and the corresponding mounted resilient bumpers 110 and 112, respectively, can be slightly rotated outward to the proper angle $\phi$. Each clamp assembly and mounted bumper is hand adjusted independently to accommodate differences from one leg to another. This toe out adjustment decreases stress on the ankles and knees and thus increases overall user comfort.

Another main function of the clamp assemblies 106 and 108 is to provide a solid mounting point for the resilient bumpers 110 and 112. Each of the resilient bumpers 110 and 112 is comprised of a low impact material such as rubber or soft plastic. These resilient materials, particularly rubber, are preferable to harder materials such as wood or metal which can cause discomfort or injury after prolonged use. However, in order to prevent deformation, the resilient bumpers 110 and 112 must also be rigid. Each of the resilient bumpers 110 and 112 includes a channel 134 in the back portion thereof. That portion of the bumpers 110 and 112 external to channel 134 forms a hook 136 as shown in FIG. 4.

The upward extending right angle section 128 of the clamp top 118 fits into the channel 134 and the hook 136 fits snugly over the right angle section 128. Since rubber or soft plastic has a high coefficient of friction, the bumpers 110 and 112 do not move on the right angle section 128 even after extended use. The right angle section 128 provides the necessary rigidity to the bumpers 110 and 112. The hook 136 can be removed from the right angle section 128 simply by applying an upward force on the bumpers 110 and 112. Thus, each of the resilient bumpers 110 and 112 are removably interlocked to the corresponding clamp assembly 106 and 108, respectively. Assembly and disassembly of the resilient bumpers 110 and 112 and the clamp assemblies 106 and 108 does not require any tools or special fasteners.

Each of the resilient bumpers 110 and 112 are slightly longer (e.g., ¼"-1") than the rigid upward extending right angle section 128. When properly attached, each rubber bumper 110 and 112 completely covers the upward extending portion of the right angle section 128. This design of the clamp top 118 ensures the prevention of injury to the user of the lateral exercise apparatus 100.

In the present invention, the impact surface of the resilient bumpers 110 and 112 must be angled off of the low friction surface layer 102 by less than or equal to 20°. The 20° impact surface angle has been shown to subject leg joints to the least amount of stress and is considered to be orthopedically correct. It is the lateral edge of the foot and the subtalar (e.g., ankle) joint that absorbs the impact when utilizing a high angle (e.g., approximately 90°) bumper design. Use of a low impact surface angle $\Theta$ of $\leqq 20°$ in combination with the toe out feature of the adjustable clamp assemblies 106 and 108 facilitates natural shock absorption and deceleration on the ball of the foot. It also allows the user to generate maximum force during acceleration since the user can push off of the bumpers 110 and 112 from the ball of the foot as opposed to the edge of the foot.

Use of the low impact surface angle $\Theta$ of $\leqq 20°$ for the bumpers 110 and 112 is supported as follows. Initially, the 20° surface angle encourages the natural deceleration process in which the ball of the foot strikes the surface layer 102 first. Then, the knees flex and the quad muscle group absorbs the body weight and inertia created by the acceleration. Finally, the heels strike the surface layer 102. The ball of the foot acts as a natural shock absorber and power point of the body. Further, a $\leqq 20°$ bumper surface angle creates the correct biomechanical position for acceleration. With the ball of the foot in contact with a resilient bumper 110 or 112 having a $\leqq 20°$ angle, it brings the entire body into correct alignment to generate effective lateral power.

Finally, it has been suggested by the American Academy of Orthopedic Surgeons that the maximum range for the ankle to safely evert is between 15°-20°. Studies have been conducted to determine the vertical ground force upon impact with a bumper of a sideboard. Sideboards which exhibit angles of 90°, 40° and 20° have been tested. While using the bumper having a 90° impact angle, the user absorbs energy on the lateral edge of the foot. The subtalar (e.g., ankle) joint is susceptible to unwanted stress. Also, alignment of the leg is very poor because the ball of the foot is not involved in absorbing energy and is only minimally involved with acceleration. The comfort level of the foot diminishes.

When using the bumper having the 40° impact angle, the ankle attempts to evert to 40° when the ball of the foot contacts the bumper during deceleration. The body will not permit an eversion of 40° to occur due to pain and compensates by changing the natural position of the leg. The leg is closer to a more natural alignment and is more efficient than when using the 90° bumper. When using the bumper having the 20° impact angle, the ankle everts to an acceptable stress level without postular correction when the ball of the foot contacts the bumper during deceleration. The legs natural shock absorption is utilized and the subtalar joint, knee and hip are in natural, e.g., proper, alignment. Because the leg alignment is correct, pushing off the bumper with full extension is achieved. Thus, efficient power and acceleration is delivered to the user.

When the foot strikes the bumper at the end of the surface layer, a vertical ground force is generated and reflected back into the legs. The higher the vertical ground force, the greater the force applied to the legs. The applied vertical ground force has been measured using bumper impact angles of 90°, 40° and 20°. The vertical force values (N) have been measured using the Kistler force plate system. When measuring the average ground force attained, the 90 bumper measured 580N, the 40° bumper measured 640N and the 20° bumper measured 544N. It is clearly evident that the bumper exhibiting an impact angle of 20° experiences the lowest average ground force value (N) and thus is preferable in minimizing stress on the leg joints. Therefore, use of an impact angle of $\leqq 20°$ is therapeutic.

It is emphasized that the lateral exercise apparatus 100 exhibits a modular construction that facilitates assembly and disassembly without any tools. The adjustable clamp assemblies are the cornerstone of the modular construction design. This feature makes transportation of the apparatus 100 and parts replacement convenient. Since the polyethylene plastic has been treated with a friction lowering additive, the surface layer 102 can be used on both sides which extends the life of the apparatus 100. The design of the present invention incorporates safety conscientious features including placement of the plastic knobs 124 behind the resilient bumpers 110 and 112.

During operation, the high friction sub-surface layer 104 is positioned upon a floor surface. Then, the low friction surface layer 102 is overlaid thereon and aligned thereto. One of the clamp bases 116 is positioned beneath the surface layer 102 at each end and adjusted to provide the desired length of the surface layer 102. The corresponding clamp tops 118 are then aligned with the threaded bolts 120 to sandwich the surface layer 102. The knobs 124 are then hand tightened to secure the surface layer 102 between the clamp assemblies 106 and 108. Thereafter, the resilient bumpers 110 and 112 are removably mounted to the right angle section 128 of the corresponding clamp tops 118. The side-to-side skating movements can now be performed on the lateral exercise apparatus 100. Upon completion of the skating movements, the apparatus can be disassembled using a procedure opposite to that for assembly.

While the present invention is described herein with reference to illustrative embodiments for particular applications, it should be understood that the invention is not limited thereto. Those having ordinary skill in the art and access to the teachings provided herein will recognize additional modifications, applications and embodiments within the scope thereof and additional fields in which the present invention would be of significant utility.

It is therefore intended by the appended claims to cover any and all such modifications, applications and embodiments within the scope of the present invention.

Accordingly,

What is claimed is:

1. A lateral exercise apparatus for use in performing side-to-side skating movements comprising:

surface layer means for performing said side-to-side skating movements on each side thereof, each side of said surface layer means having a very low coefficient of friction;

adjustable clamping means for adjusting the length of said surface layer means, said clamping means including at least one pair of releasable clamping surfaces for gripping said surface layer means;

resilient bumper means removably interlocked to one of said releasable clamping surfaces of said clamping means for terminating said side-to-side skating movements, said resilient bumper means having a low impact surface angle of less than or equal to 20°; said resilient bumper means comprises a channel for receiving a raised portion of one of said releasable clamping surfaces of said adjustable clamping means to form a removable interlock between said bumper means and said clamping means; and high friction layer means for underlying and securing said surface layer means to a floor surface.

2. The lateral exercise apparatus of claim 1 wherein said surface layer means comprises a layer of high density polyethylene material.

3. The lateral exercise apparatus of claim 1 wherein said surface layer means comprises a friction lowering additive for providing said very low coefficient of friction.

4. The lateral exercise apparatus of claim 1 wherein said at least one pair of releasable clamping surfaces of said adjustable clamping means comprises a clamp top and a corresponding clamp base.

5. The lateral exercise apparatus of claim 4 wherein said clamp top is releasably secured to said corresponding clamp base by a plurality of threaded bolts and knobs.

6. The lateral exercise apparatus of claim 4 wherein said clamp top and corresponding clamp base are independently adjustable for changing the planar angle between said clamp top and corresponding clamp base and said floor surface.

7. The lateral exercise apparatus of claim 4 further including a plurality of rubbers bands wrapped about said clamp base for increasing the friction between said clamp base and said surface layer means and between said clamp base and said high friction layer means.

8. The lateral exercise apparatus of claim 1 wherein said resilient bumper means is comprised of rubber.

9. The lateral exercise apparatus of claim 1 wherein said resilient bumper means is comprised of plastic.

10. The lateral exercise apparatus of claim 1 wherein said high friction layer means comprises a combination of nylon and polyvinylchloride.

11. The lateral exercise apparatus of claim 1 wherein said surface layer means and said high friction layer means are flexible for providing portability.

12. A lateral exercise apparatus for use in performing side-to-side skating movements comprising:

a top surface layer for performing said side-to-side skating movements on each side thereof, each side of said top surface layer having a very low coefficient of friction;

a plurality of adjustable clamps for adjusting the length of said top surface layer, each of said adjustable clamps including a pair of releasable clamping surfaces for gripping said top surface layer;

a plurality of resilient bumpers removably interlocked to one of said releasable clamping surfaces of each of said adjustable clamps for terminating said side-to-side skating movements, said resilient bumpers having a low impact surface angle of less than or equal to 20°; said resilient bumper comprises a channel for receiving a raised portion of one of said releasable clamping surfaces of said adjustable clamps to form a removable interlock between said bumper and said clamps; and a high friction layer for underlying and securing said top surface layer to a floor surface.

13. A method of constructing a lateral exercise apparatus for use in performing side-to-side skating movements, said method comprising the steps of:

extending a top surface layer on a floor surface for performing said side-to-side skating movements on each side thereof, each side of said top surface layer having a very low coefficient of friction;

underlying and securing said top surface layer to said floor surface with a high friction layer;

adjusting the length of and gripping said top surface layer between a pair of releasable clamping surfaces of each of a plurality of adjustable clamps; and interlocking a plurality of resilient bumpers to one of said releasable clamping surfaces of each of said adjustable clamps for terminating said side-to-side skating movements, said resilient bumpers having a low impact surface angle of less than or equal to 20° further including the step of forming a channel in each of said resilient bumpers for receiving a raised portion of a corresponding adjustable clamp to form a removable interlock between said bumpers and said clamps.

14. The method of claim 13 wherein the step of adjusting the length of said top surface layer further includes the step of securing a plurality of clamp tops to a corresponding plurality of clamp bases.

15. The method of claim 13 further including the step of wrapping a plurality of rubber bands about each of said adjustable clamps for increasing the friction between said adjustable clamps and said top surface layer and between said adjustable clamps and said high friction layer.

* * * * *